US007906954B2

(12) United States Patent
Kudo

(10) Patent No.: US 7,906,954 B2
(45) Date of Patent: Mar. 15, 2011

(54) BIAS CIRCUIT

(75) Inventor: Masahiro Kudo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/058,401

(22) Filed: Mar. 28, 2008

(65) Prior Publication Data

US 2008/0191680 A1 Aug. 14, 2008

Related U.S. Application Data

(63) Continuation of application No. PCT/JP2005/018132, filed on Sep. 30, 2005.

(51) Int. Cl.
*G05F 3/20* (2006.01)

(52) U.S. Cl. ..... 323/315; 323/316

(58) Field of Classification Search ..... 323/312–317; 327/539–541; 330/253, 255, 297
See application file for complete search history.

(56) References Cited

U.S. PATENT DOCUMENTS

| | | | | |
|---|---|---|---|---|
| 4,897,596 | A * | 1/1990 | Hughes et al. | 323/315 |
| 6,316,998 | B1 * | 11/2001 | Oikawa | 330/255 |
| 6,429,744 | B2 * | 8/2002 | Murray et al. | 330/267 |
| 6,680,643 | B2 * | 1/2004 | Conte et al. | 327/539 |
| 6,788,146 | B2 * | 9/2004 | Forejt et al. | 330/257 |
| 2004/0108889 | A1 | 6/2004 | Kizaki et al. | |

FOREIGN PATENT DOCUMENTS

| | | | |
|---|---|---|---|
| JP | 03-099518 | A | 4/1991 |
| JP | 06-164360 | A | 6/1994 |
| JP | 2004-187150 | A | 7/2004 |

OTHER PUBLICATIONS

"Extended European Search Report", mailed by EPO and corresponding to European patent application No. 05 78 8272.2 on Sep. 29, 2010.

* cited by examiner

*Primary Examiner* — Adolf Berhane
*Assistant Examiner* — Emily Pham
(74) *Attorney, Agent, or Firm* — Fujitsu Patent Center

(57) ABSTRACT

A control circuit U1 comprises four PMOS transistors MP1-MP4 and receives a voltage Vn and a voltage Vss. MP1 and MP3, and, MP2 and MP4 are respectively connected in series between power supply Vdd and a fixed voltage Vss. Gate terminal of MP2 is connected to Vss. Reference current and its copy current F1 respectively flow through NMOS transistors M1 and M2, of which respective source terminals are connected to Vss. Gate width of M2 is a quarter of that of M1. Drain terminal is connected to the gate terminals of MP1 and MP2. Node between source terminal of MP2 and drain terminal of MP3 is connected to gate terminal of MP1, and node between source terminal of MP2 and drain terminal of MP4 is connected to gate terminal of MP2. The control circuit U1 controls gate terminal voltage of M1 to make an overdrive voltage of M1 becomes Vn.

8 Claims, 11 Drawing Sheets

BIAS CIRCUIT

CROSS REFERENCE TO RELATED APPLICATION

This application is a continuation of international PCT application No. PCT/JP2005/018132 filed on Sep. 30, 2005.

BACKGROUND OF THE INVENTION

1. Field of the Invention

The present invention relates to a logic circuit using a voltage drive type transistor and in particular to a bias circuit used for a system such as LSI.

2. Description of the Related Art

Recent years have witnessed rapid progress in one-chip integration of systems by virtue of complementary metal oxide semiconductors (CMOS) and, associated with this, an increasing demand for a low voltage operating analog circuits. In large scale integration (LSI), it is believed that a digital circuit will operate with a power supply of 1.2 or 1 volts in the future, and this requires that an analog circuit operate on a similar power supply voltage as that of a digital circuit. This brings to the surface the problem caused by the setup of the bias current of a MOS transistor and by variations in the characteristics of MOS transistors in an analog circuit. The variation in the characteristics of the MOS transistors is due to the variation in the fabrication process. Here, the characteristics of the MOS transistors are such as β and Vth.

β is expressed by:

$$\beta=\mu CoxW/L,$$

where μ, Cox, W and L are the mobility of a MOS transistor, the capacitance of the oxide film of the gate, the gate width and the gate length, respectively. The Vth is the threshold voltage of a MOS transistor.

Here, a description of a bias circuit is provided. The bias circuit is the basis for an analog circuit and is important for assuring stable operation of a circuit. The bias circuit is especially important when designing a high-performance analog circuit and a low-voltage operation circuit.

Analog circuits mainly use a MOS transistor operating on a saturated region. Where the overdrive voltage Vod of the MOS transistor is defined as Vod=Vgs−Vth, a bias voltage is determined so as to make the value of the Vds of the MOS transistor operate in a saturated region in an analog circuit larger than the Vod. Here, the Vth, Vgs and Vds are the threshold voltage, the voltage between the gate and source, and the voltage between the drain and source, of the MOS transistor, respectively.

A CMOS analog circuit is constituted by connecting, between the power supply voltages, a plurality of stages of MOS transistors operating in a saturated region, and therefore the sum of the Vds of the MOS transistor in the individual current paths is equal to the value of the power supply voltage. Therefore, the Vod of the MOS transistor must be set at a progressively smaller level as the power supply voltage is reduced.

Next is a description of the reason. The "upper limit of Vod" of each MOS transistor is determined by the power supply voltage and by the signal amplitude. Accordingly, if the Vod is varied by the fabrication variation, temperature and such, a Vodmax needs to be constrained within the upper limit of the Vod noted above, where the variation range of the Vod is between Vodmin and Vodmax (where the Vodmin is the minimum value of the Vod, and the Vodmax is the maximum value of the Vod). This results inevitably in setting the typical (i.e., on the average) Vod to be smaller than the upper limit of the Vod. The reason is that otherwise the Vodmax exceeds the upper limit of the Vod.

The Vod is determined by the characteristic of a MOS transistor and bias current, where the characteristic of the MOS transistor is varied by the fabrication process. If the bias circuit of the MOS transistor generates a bias current varying the Vod in relation to the variation of the fabrication process, the upper limit of the varying Vod is limited by the power supply voltage as described above, thereby causing the lower limit of the varying Vod to become further smaller in value compared with the limit of the power supply voltage. In the MOS transistor operating on a small Vod, the noise characteristic and matching characteristic are degraded. The degradations of the aforementioned two characteristics are remarkable if there is a need to consider the operation of a MOS transistor on a very small Vod at a low power-supply voltage due to the fabrication process.

Next, a detailed description of the mechanism of degradations of the noise characteristic and matching characteristic of a MOS transistor operating on a small Vod is provided.

Here, the description is provided by exemplifying a current mirror as one of the important analog element circuits.

The drain current Id of a MOS transistor operating in a saturated characteristic zone is given by $$Id=(\beta/2)Vod^2$$

using the square-root law, where the β is a constant determined by the fabrication process and temperature and by the size of the transistor.

In this case, parameter gm (i.e., mutual inductance) indicating a change in current relative to a change in the voltage of the MOS transistor in given by $$gm=dId/dVod=\beta Vod$$

This results in:

$$gm=2Id/Vod$$

The above expression makes it comprehensible that the amount gm of the change in current relative to the Vod is inversely proportional to the Vod under the condition of a certain bias current Id. Further, since Vod=Vgs−Vth, the Vod is varied by noise (i.e., flicker noise or/and external noise) overlapped on the Vgs and by the error in Vth (i.e., the variation in Vths of the fabricated individual MOS transistors). The ratio of the variation of the Vod to the error in current can be defined as the gm, and therefore the larger the gm under the condition of a certain bias current Id becomes, the greater the influence of the error in noise and matching. Therefore, the smaller the Vod inversely proportional to the value of gm becomes, the more the noise characteristic and matching characteristic degrade.

A bias circuit compensating the variations of bias current and the variations of the gm of a transistor and maintaining it against the variations of the fabrication process has conventionally been invented. A bias circuit compensating for the variation in Vod of a transistor relative to the fabrication process variation of the transistor, however, has not been invented.

SUMMARY OF THE INVENTION

A bias circuit according to the present invention comprises a current mirror having an arbitrary mirror ratio; a first transistor in which a reference current of the current mirror flows; a second transistor in which a replica current of the current mirror flows; and a control circuit for applying a voltage to the gate terminals of the first and second transistors, wherein the source terminals of the first and second transistors are connected to a common fixed potential and the control circuit comprises two voltage input terminals.

DESCRIPTION OF THE REFERRED EMBODIMENTS

The following is a description of the preferred embodiment of the present invention by referring to the accompanying drawings.

Figure 1:
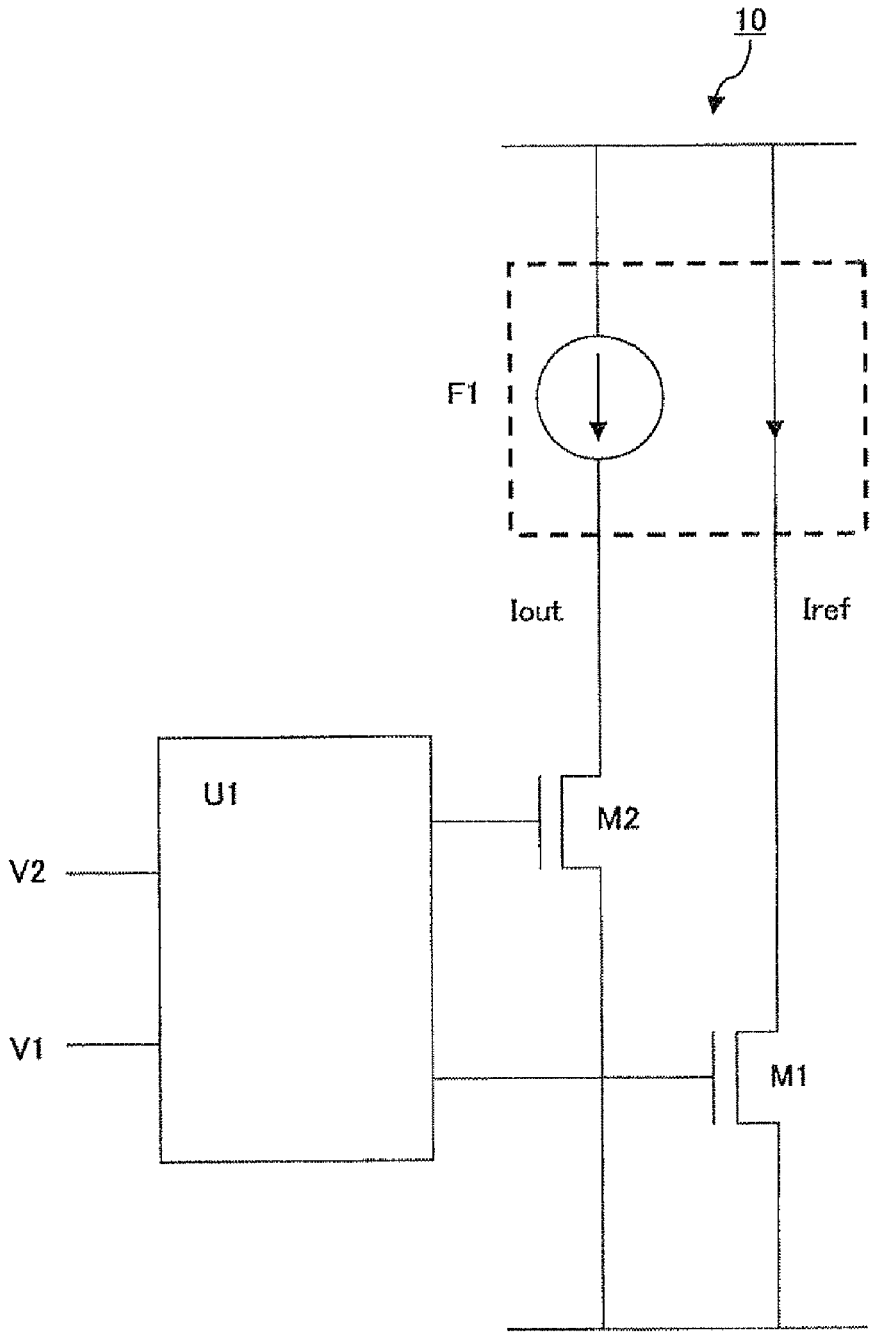
FIG. 1 is a conceptual diagram describing the principle of a bias circuit according to the present invention.

FIG. 1 is a conceptual diagram describing the principle of a bias circuit according to the present invention.

The bias circuit 10 shown in FIG. 1 comprises a current mirror F1 having an arbitrary mirror ratio, a first transistor M1 in which a reference current of the current mirror F1 flows, a second transistor M2 in which the replica current of the current mirror F1 flows and a control circuit U1 for applying a voltage to the gate terminals of the first and second transistors M1 and M2.

The configuration shown in FIG. 1 uses n-channel MOSFET (NMOS transistors) for the first and second transistors M1 and M2; however, p-channel MOS transistors (PMOS transistors) may be used instead.

The current mirror F1 has a mirror ratio K and outputs a reference current Iref and a replica current Iout (which is K times the reference current Iref).

The control circuit U1, comprising a first input terminal to which a voltage V1 is applied and a second input terminal to which a voltage V2 is applied, has the function of supplying the transistors M1 and M2 with a gate terminal voltage so that the difference in potential (also noted as "potential difference" hereinafter) of the gate terminal voltages between the first transistor M1 (simply noted as "transistor M1" hereinafter) and second transistor M2 (simply noted as "transistor M2" hereinafter) is equal to the potential difference between the voltages V1 and V2 and also that the same current amount as that of the replica current Iout of the current mirror F1 flows through the transistor M2. Here, the input terminal voltages V1 and V2 of the control circuit are not necessarily the same as the gate terminal voltage of the transistors M1 and M2, respectively.

Figure 2:
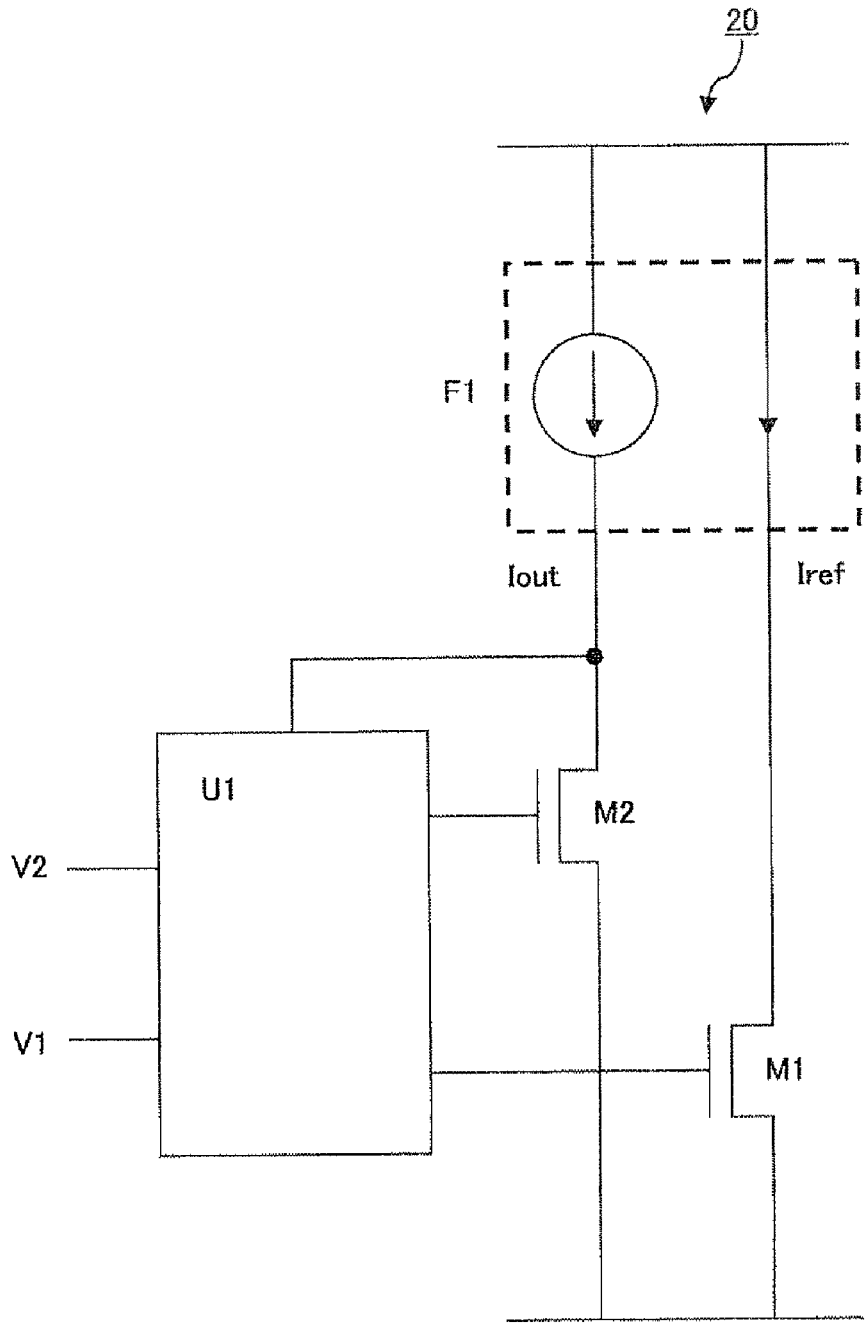
FIG. 2 is a conceptual diagram limiting the configuration of the bias circuit shown in FIG. 1.

FIG. 2 is a conceptual diagram limiting the configuration of the bias circuit shown in FIG. 1.

In FIG. 2, the same component sign is assigned to the same constituent component as that of the bias circuit of FIG. 1 and descriptions of the overlapping parts are not provided here.

The bias circuit 20 shown in FIG. 2 differs from the bias circuit shown in FIG. 1 at the point where the control circuit U1 is connected to the drain terminal of the NMOS transistor M2.

The control circuit U1 controls the gate terminal voltage of the NMOS transistors M1 and M2 by utilizing the drain terminal of the NMOS transistor M2. The control circuit U1 judges whether or not the transistor M2 allows the same current amount as that of the replica current Iout of the current mirror F1 to flow on the basis of the drain terminal voltage of the transistor M2, thereby accomplishing the aforementioned control.

As an example, if the current of the transistor M2 is larger than the replica current Iout of the current mirror F1, the current supplied to the drain terminal of the transistor M2 is exceeded by the current extracted therefrom, thereby making the drain terminal voltage of the transistor M2 decrease. In contrast, if the current of the transistor M2 is smaller than the replica current Iout of the current mirror F1, the drain terminal voltage of the transistor M2 decreases.

Therefore, the control circuit U1 compares the replica current Iout of the current mirror F1 with the current of the transistor M2 by using the drain terminal thereof, thereby making it possible to control the gate terminal voltage of the transistors M1 and M2. Further, configuring to cause a short-circuit between the gate terminal and drain terminal of the transistor M2 at the inside of the control circuit U1 and monitoring the drain terminal voltage of the transistor M2 (i.e., the gate terminal voltage of the transistor M2) makes it possible to control also the gate terminal voltage of the transistor M1.

Figure 3:
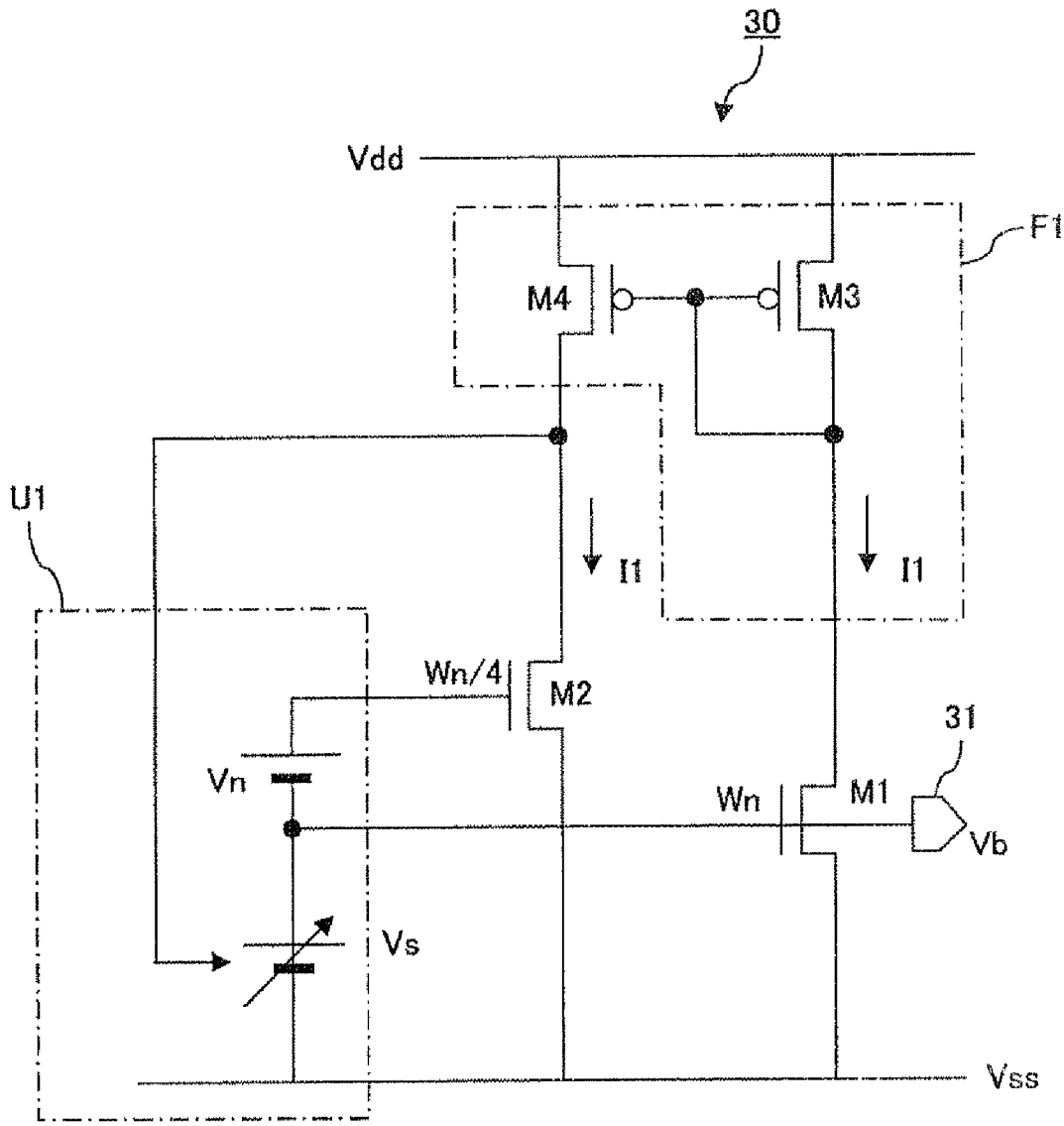
FIG. 3 is a conceptual diagram exemplifying a further specific configuration of the bias circuit shown in FIG. 2.

FIG. 3 is a conceptual diagram exemplifying a further specific configuration of the bias circuit 20 shown in FIG. 2. In FIG. 3, the same component sign is assigned to the same constituent component as that of the bias circuit 20 of FIG. 2 and descriptions of the overlapping parts are not provided here.

The bias circuit 30 shown in FIG. 3 is a bias circuit comprising the output terminal 31 of a bias voltage Vb, which is also the gate terminal voltage of the transistor M1. In the bias circuit 30, the gate width of the transistor M2 is a quarter of the gate width of the transistor M1, and the mirror ratio K of the current of the current mirror F1 is "1". This makes Iref=Iout(I1). Meanwhile, the input terminal voltages V1 and V2 of the control circuit U1 are "0" volts (Vss) and Vn, respectively.

The current mirror F1, comprising a first p-channel MOSFET (i.e., a PMOS transistor) M3 and a second p-channel MOSFET (i.e., a PMOS transistor) M4, replicates a current I1 flowing in the NMOS transistor M1 and supplies the NMOS transistor M2 with the current I1. The PMOS transistors M3 and M4 are parallelly connected to a reference power supply Vdd, and their source terminals are connected to the reference power supply Vdd. The gate terminal of the PMOS transistor M3 and that of the PMOS transistor M4 are interconnected, with the gate terminals of the PMOS transistors M1 and M2 being connected to the drain terminal of the PMOS transistor M3. The drain terminal of the PMOS transistor M3 is connected to the drain terminal of the NMOS transistor M1, and the drain terminal of the PMOS transistor M4 is connected to the drain terminal of the NMOS transistor M2.

The control circuit U1 comprises the function expressed by the serially interconnected constant voltage supply Vn and variable voltage supply Vs, with the positive pole of the constant voltage supply Vn being connected to the gate terminal of the NMOS transistor M2. The negative pole of the variable voltage supply Vs is connected to the reference potential Vss.

The control circuit U1 shifts the input terminal voltages V1 and V2 by the amount of Vs, and gives the shifted voltages V1+Vs and V2+Vs to the respective gate terminals of the transistor M1 and M2. Then, the control circuit U1 controls so as to decrease the Vs if the drain terminal voltage is high, and increase the Vs if the drain terminal voltage is low, on the basis of the drain terminal voltage of the transistor M2, thereby controlling the gate terminal voltage of the transistors M1 and M2.

Here, a detailed description of the operation for controlling the gate terminal voltage of the transistors M1 and M2 at the control circuit U1 is provided.

Assuming that the current of a transistor in the saturated region follows the square-root law, the currents IM1 and IM2 of the transistors M1 and M2 are respectively expressed by the following expressions (1) and (2):

$$IM1=(\mu Cox/2)(Wn/L)(Vs-Vth)^2 \quad (1) \text{ and}$$

$$IM2=(\mu Cox/2)(Wn/4L)(Vs+Vn-Vth)^2 \quad (2),$$

where μ is a mobility, Cox is a gate capacity per unit area, Wn is the gate width of the transistor, L is the channel length of the transistors M1 and M2, and Vth is the threshold voltage of the transistors M1 and M2.

The current mirror F1 makes IM1=IM2, and therefore from expressions (1) and (2) the following expression (3) is derived:

$$(\mu Cox/2)(Wn/L)(Vs-Vth)^2=(\mu Cox/2)(Wn/4L)(Vs+Vn-Vth)^2 \quad (3)$$

Taking the root of both sides of the expression (3):

$$(Vs-Vth)=(Vs+Vn-Vth)/2 \quad (4),$$

thereby obtaining:

$$Vs-Vth=Vn \quad (5)$$

The overdrive voltage of a transistor is defined by:

(the voltage between the gate and source−threshold voltage)

and therefore the left side of the expression (5) becomes the overdrive voltage of the transistor M1. Accordingly, in the bias circuit 30, control is carried out so that the overdrive voltage of the transistor M1 is Vn (i.e., the potential difference between the input terminal voltages V1 and V2 of the control circuit U1 in this example).

The configuration example is hereafter described by exemplifying the case in which the mirror ratio of the current of the current mirror F1 is "1", the gate width of the transistor M2 is a quarter of the gate width of the transistor M1, and the current of the transistor follows the square-root law; the present invention, however, is also valid in cases other than the aforementioned limited condition. In general, assuming that the mirror ratio of the current of the current mirror is "K", the gate width of the transistor M2 is 1/N of the gate width of the transistor M1, and the current of the transistor in the saturated zone is proportional to the overdrive voltage to the power of α, then the overdrive voltage Vod of the transistor M1 is expressed by the following expression (6):

$$Vod=Vn/((KN)^{1/\alpha}-1) \quad (6)$$

As described above, it is possible to control the overdrive voltage of the transistor M1 arbitrarily to a value proportional to the Vn in general cases. FIG. 3 exemplifies the case of assuming K=1, N=4 and α=2 in the expression (6) and intending to make the overdrive voltage of the transistor M1 equal to Vn.

[Description of Operation of the Bias Circuit Shown in FIG. 3]

Figure 4:
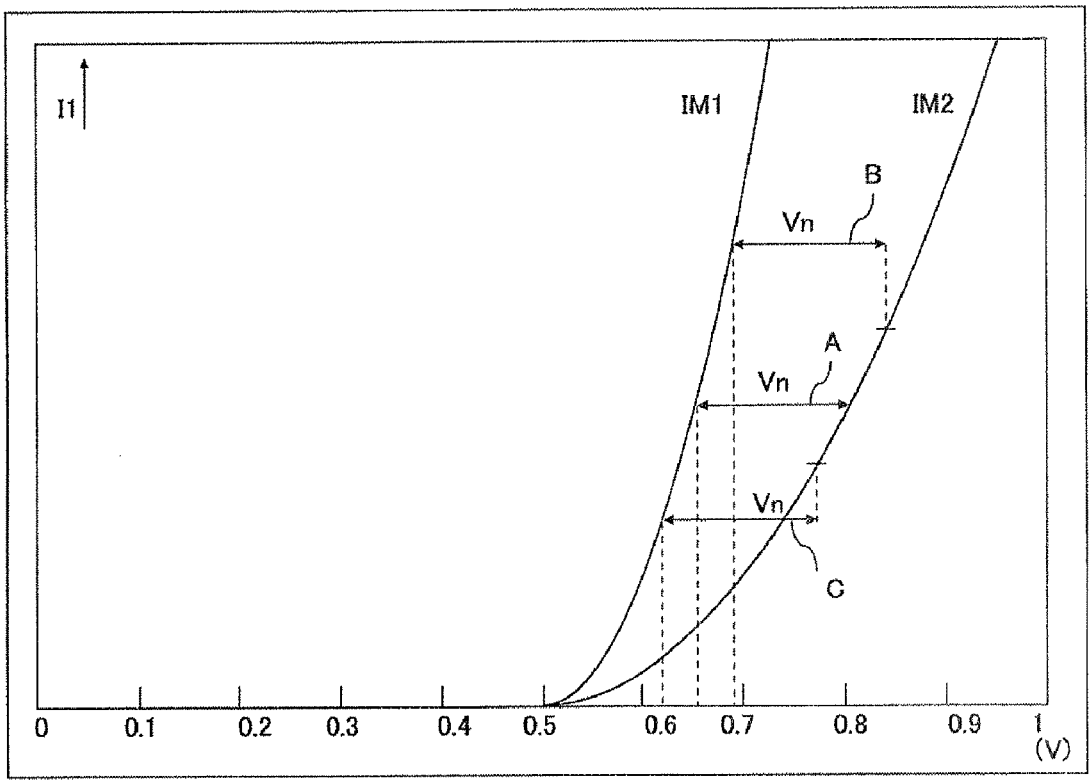
FIG. 4 is a graph for describing an operation of the bias circuit shown in FIG. 3.

Next is a detailed description of the control of the aforementioned bias circuit 30 by referring to FIG. 4.

Referring to the graph of FIG. 4, the vertical axis is the current I1 of the current mirror F1, and the horizontal axis is the gate terminal voltage of the transistors M1 and M2. Here, the assumption is that the threshold voltage of the transistors M1 and M2, which are NMOS transistors, is 0.5 volts.

In FIG. 4, the IM1 and IM2 are the respective currents of the NMOS transistors M1 and M2. The currents IM1 and IM2 show the characteristics of square-root low of the gate terminal voltages of the transistors M1 and M2, respectively. The gate width of the transistor M1 is four times the gate width of the transistor M2, and therefore the IM1 for a certain gate voltage is four times the IM2. The absolute size and threshold voltage of the currents IM1 and IM2 of the transistors M1 and M2 vary with the fabrication process and the size of the transistors.

The bias circuit 30 shown in FIG. 3 is placed in a state in which the gate terminal voltage of the transistor M2 is higher than that of the transistor M1 by the amount of Vn and in which the transistors M1 and M2 are equal to each other. As an example, setting Vn=0.15 volts, the condition is satisfied with the gate terminal voltage of the transistor M1 being 0.65 volts as indicated by the horizontal arrow in the center and the vertical dotted line associated with the horizontal arrow.

That is, the currents IM1 and IM2 are the same in the state in which the difference in the gate terminal voltages between the transistors M2 and M1 is exactly Vn. In this event, the gate terminal voltage of the transistor M1 is 0.65 volts and the threshold voltage is 0.5 volts, and therefore control is performed to cause the overdrive voltage of the transistor M1 to be 0.15 volts (=Vn).

Next is a description of the process of the above described control converging through negative feedback in the bias circuit 30.

At a point at which the gate terminal voltage of the transistor M1 is higher than an eventually converging voltage (i.e., 0.65 volts in this example), the current IM2 of the transistor M2 is smaller than the current IM1 of the transistor M1 (refer to the horizontal arrow B in the upper part of FIG. 4). In this event, the drain terminal voltage of the transistor M2 is increased, whereas the control circuit U1 performs control so as lower the gate terminal voltage of the transistors M1 and M2 if the drain terminal voltage of the transistor M2 is increased, and therefore control is performed so that the gate terminal voltage of the transistor M1 moves in the right direction, that is, moves to approach the eventually converging voltage (i.e., a lower voltage than the current voltage).

In contrast, at a point where the gate terminal voltage of the transistor M1 is lower than the eventually converging voltage, the current IM2 of the transistor M2 is larger than the current IM1 of the transistor M1 (refer to the horizontal arrow C in the lowest part of FIG. 4). In this event, the control circuit U1 controls so as to increase the gate terminal voltage of the transistors M1 and M2 if the drain terminal voltage of the transistor M2 decreases, and therefore the gate terminal voltage of the transistor M1 moves in the right direction, that is, moves to approach the eventually converging voltage (i.e., a higher voltage than the current one).

As such, the bias circuit 30 is enabled to control the overdrive voltage of the transistors M1 and M2 at an arbitrary voltage Vn even if the characteristics of the transistors M1 and M2 are varied by the fabrication process and temperature.

Figure 5:
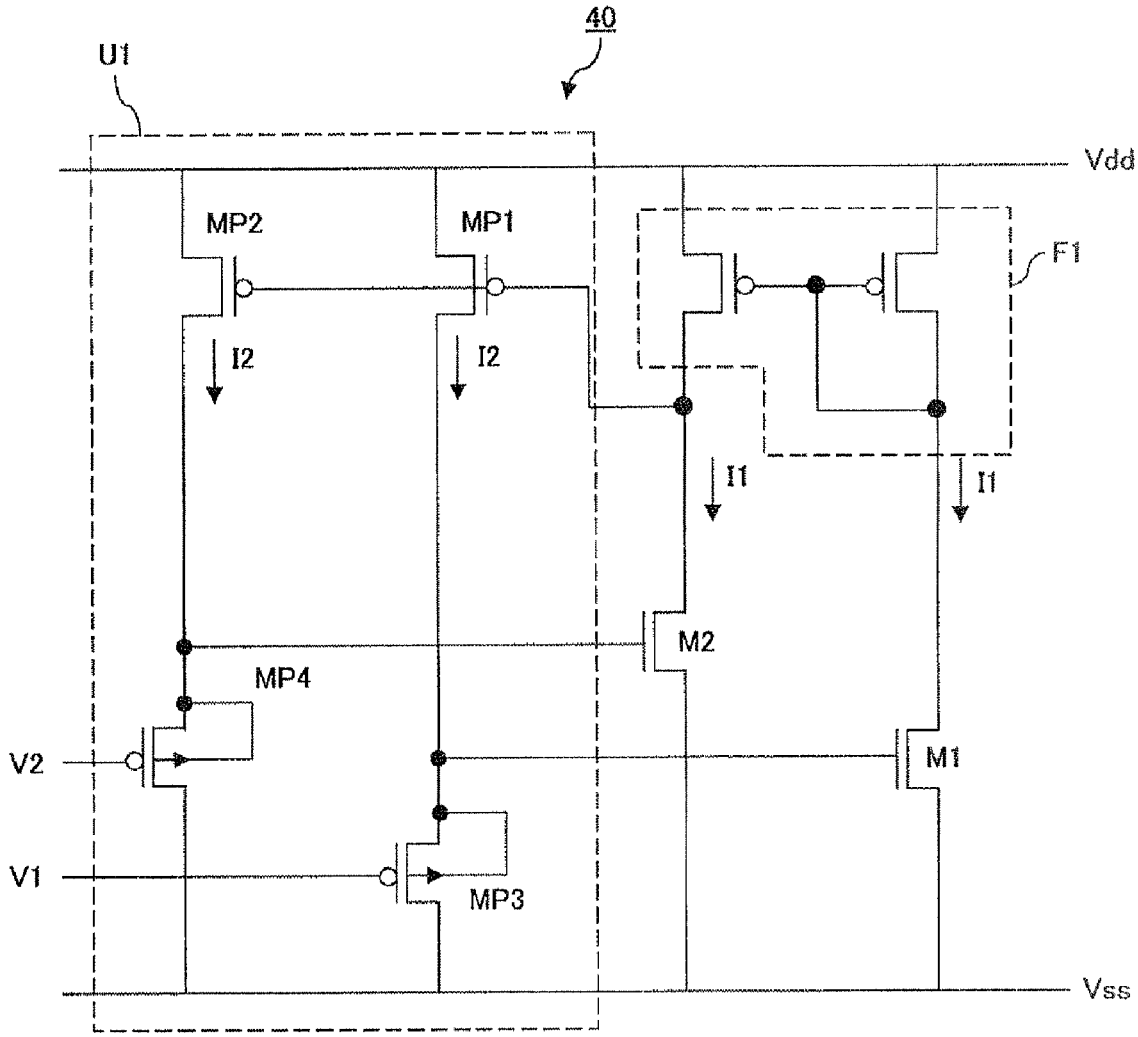
FIG. 5 is a diagram showing a first preferred embodiment of the bias circuit shown in FIG. 2.

FIG. 5 is a diagram showing a first preferred embodiment of the bias circuit 20 shown in FIG. 2, exemplifying a specific configuration of the control circuit U1 at the transistor level. Note that, in FIG. 5, the same component sign is assigned to the same constituent component as that of the bias circuit 30 shown in FIG. 3, and descriptions of the overlapping parts are not provided here.

In the bias circuit 40 shown in FIG. 5, the control circuit U1 comprises four p-channel MOSFETs (i.e., PMOS transistors) MP1 through MP4.

The PMOS transistor MP1 and PMOS transistor MP3 are serially connected between a reference power supply Vdd and a Vss, while the drain terminal of the PMOS transistor MP1 and the source terminal of the PMOS transistor MP3 are interconnected. Likewise, the PMOS transistor MP2 and PMOS transistor MP4 are serially connected between the reference power supply Vdd and Vss, while the drain terminal of the PMOS transistor MP2 and the source terminal of the PMOS transistor MP4 are interconnected. Further, the source terminal of the PMOS transistor MP3 is connected to the gate terminal of the NMOS transistor M1, and the source terminal of the PMOS transistor MP4 is connected to the gate terminal of the NMOS transistor M2.

The PMOS transistors MP1 and MP2 generate a current I2 on the basis of the drain terminal voltage on the NMOS transistor M2. In this event, the higher the drain terminal voltage of the NMOS transistor M2, the more the current I2 decreases because (the absolute value of) the voltage between the gate and source of the PMOS transistors MP1 and MP2 is low. Further, the lower the drain terminal voltage of the NMOS transistor M2, the more the current I2 increases because (the absolute value of) the voltage between the gate and source of the PMOS transistors MP1 and MP2 is high.

The current I2 generated by the PMOS transistors MP1 and MP2 are respectively input into the source terminals of the PMOS transistors MP3 and MP4.

The gate terminals of the PMOS transistors MP3 and MP4 are respectively provided with voltages V1 and V2. In the case of the bias circuit 40 shown in FIG. 5, V1="0" volts (Vss) and V2=Vn result. The voltage between the gate and source of the PMOS transistors MP3 and MP4 is determined by the current I2, with the absolute value of the voltage increasing with the current I2. Here, the absolute value of the voltage between the gate and source of the PMOS transistors MP3 and MP4 is defined as |Vgsp|. The |Vgsp| is equivalent to the function of the variable voltage supply Vs of the bias circuit 30 shown in FIG. 3.

The PMOS transistors MP3 and MP4 are respectively provided with "0", volts and Vn as gate terminal voltages and therefore the source terminal voltages increases in relation to the gate terminal voltages by |Vgsp|. In this case, the source terminal voltage of the PMOS transistor MP3 becomes |Vgsp| and that of the PMOS transistor MP4 becomes |Vgsp|+Vn.

As described above, the |Vgsp| decreases in proportion to the drain terminal voltage of the NMOS transistor M2 and increases in inverse proportion to the drain terminal voltage of the NMOS transistor M2. Therefore, the control circuit U1 controls so as to decrease (the absolute value of) the gate terminal voltage of the NMOS transistors M1 and M2 if the drain terminal voltage of the NMOS transistor M2 is high, and to increase (the absolute value of) the gate terminal voltage of the NMOS transistors M1 and M2 if the drain terminal voltage is low, on the basis of the drain terminal voltage of the NMOS transistor M2 (refer to FIG. 4).

As such, the bias circuit 40 is also enabled to control the overdrive voltage of the transistors M1 and M2 at an arbitrary voltage Vn even if the characteristic of the transistor M1 is varied by the fabrication process and temperature.

Figure 6:
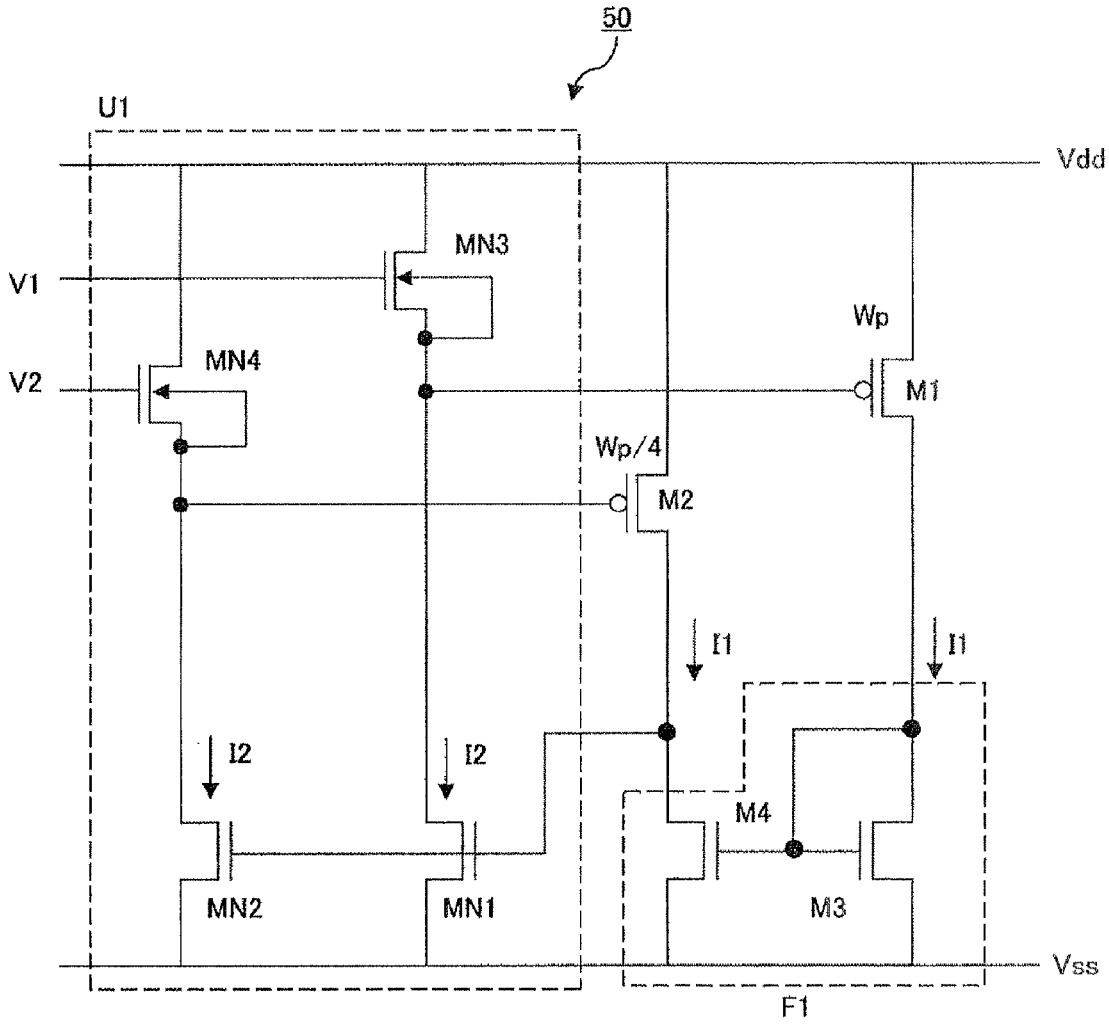
FIG. 6 is a diagram showing a second preferred embodiment of the bias circuit shown in FIG. 2.

FIG. 6 is a diagram showing a second preferred embodiment of the bias circuit 20 shown in FIG. 2.

The bias circuit 50 shown in FIG. 6 is configured to reverse the conductivity type of the MOS transistor used in the bias circuit 40 of FIG. 4. That is, the MOS transistors MN1 through MN4 are NMOS transistors of the control circuit U1, and the MOS transistors M3 and M4 of the current mirror F1 are also NMOS transistors. Meanwhile, the transistors M1 and M2 are PMOS transistors.

The bias circuit 50 is configured such that the control circuit U1 and current mirror F1 are different from the bias circuit 40 in association with the reversal of the transistors described above.

In the control circuit U1, the source terminals of the NMOS transistors MN1 and MN2 are connected to a reference potential Vss, and the drain terminals of the NMOS transistors MN3 and MN4 are connected to the power supply Vdd. In the current mirror F1, the source terminals of the NMOS transistors MN3 and MN4 are connected to the reference potential Vss. Further, the source terminals of the PMOS transistors M1 and M2 are connected to the power supply Vdd, and the configuration is such that the same current amount I1 flows by virtue of the current mirror F1.

The control circuit U1 of the bias circuit 50 monitors the drain terminal voltage of the PMOS transistor M2, thereby controlling the gate terminal voltage of the PMOS transistors M1 and M2 appropriately by virtue of negative feedback. The control operation of the control circuit U1 of the bias circuit 50 is approximately similar to the operation of the control circuit U1 of the bias circuit 40 and therefore a detailed description is not provided here.

Figure 7:
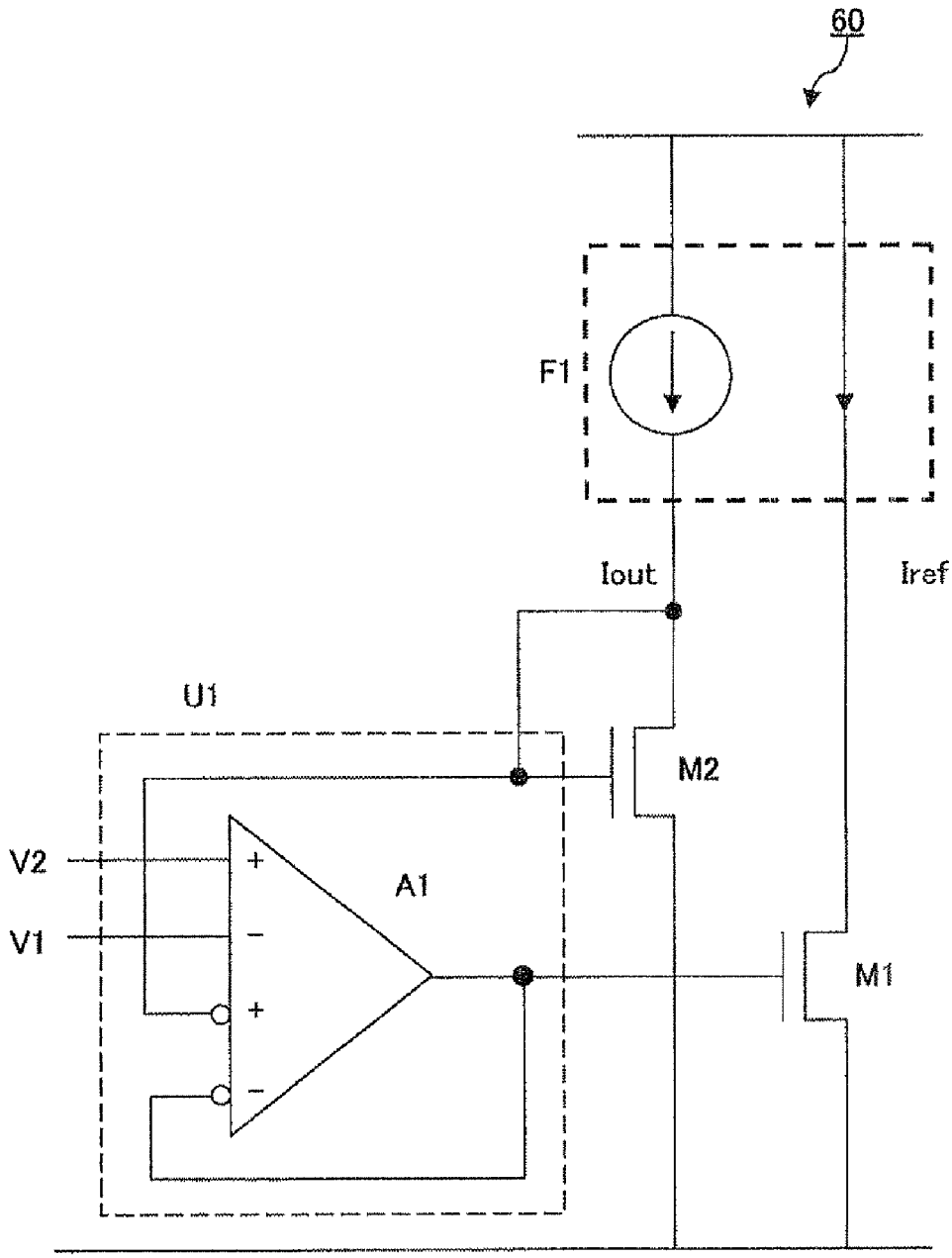
FIG. 7 is a diagram showing a third preferred embodiment of the bias circuit shown in FIG. 2.

FIG. 7 is a diagram showing a third preferred embodiment of the bias circuit 20 shown in FIG. 2. In FIG. 7, the same component sign is assigned to the same constituent component as that of the bias circuit 20 shown in FIG. 2, and descriptions of the overlapping part are not provided here. Further, the transistors M1 and M2 are NMOS transistors in the configuration of FIG. 7; however, they may be PMOS transistors.

The control circuit U1 of the bias circuit 60 shown in FIG. 7 comprises a differential amplifier A1.

Figure 8:
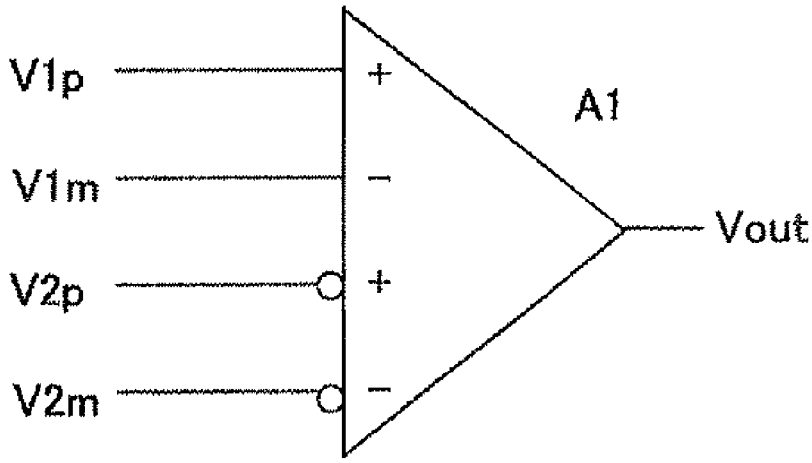
FIG. 8 is a diagram showing an input/output configuration of the differential amplifier of the control circuit U1 shown in FIG. 7.

FIG. 8 is a diagram showing the configuration of the differential amplifier A1.

The differential amplifier A1 comprises an output terminal Vout and four input terminals to which the voltages V1*p*, V1*m*, V2*p* and V2*m* are respectively input. The differential amplifier A1 is for comparing two differential signals and outputting a voltage, and in this amplifier the two differential signals are respectively given by V1*p* and V1*m*, and V2*p* and V2*m*. Assuming that the gain of the differential amplifier A1 is "G" in this event, the Vout is given by the following expression (7):

$$Vout=G((V1p-V1m)-(V2p-V2m))+Vc \quad (7),$$

where Vc is the Vout when the input is in an equilibrium state, and the Vc takes an arbitrary value.

Figure 9:
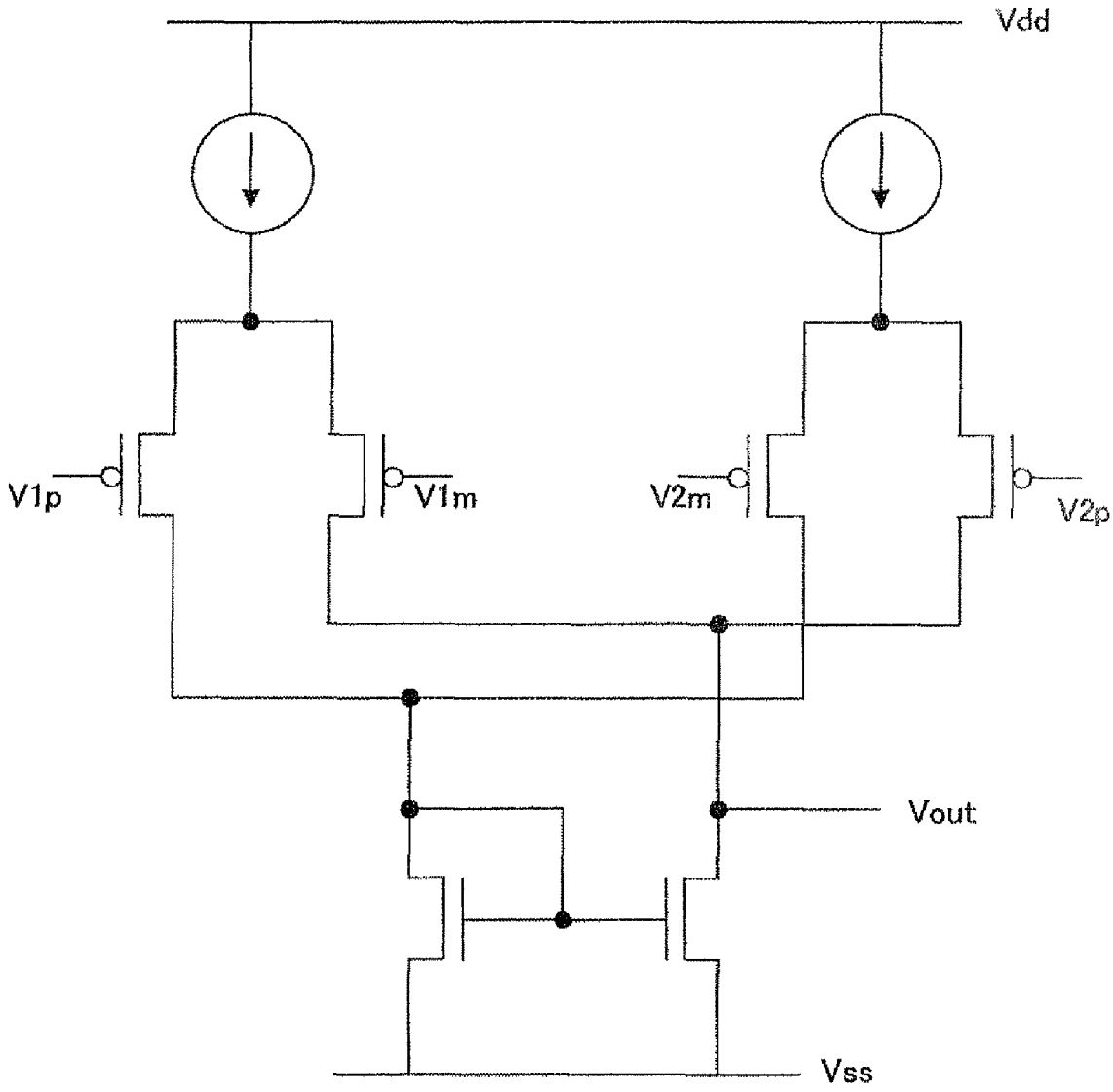
FIG. 9 is a diagram showing a circuit configuration of the differential amplifier shown in FIG. 8.

The differential amplifier A1 is for example constituted by the circuit as shown in FIG. 9. The configuration shown in FIG. 9 is known and therefore a detailed description is not provided herein.

Figure 10:
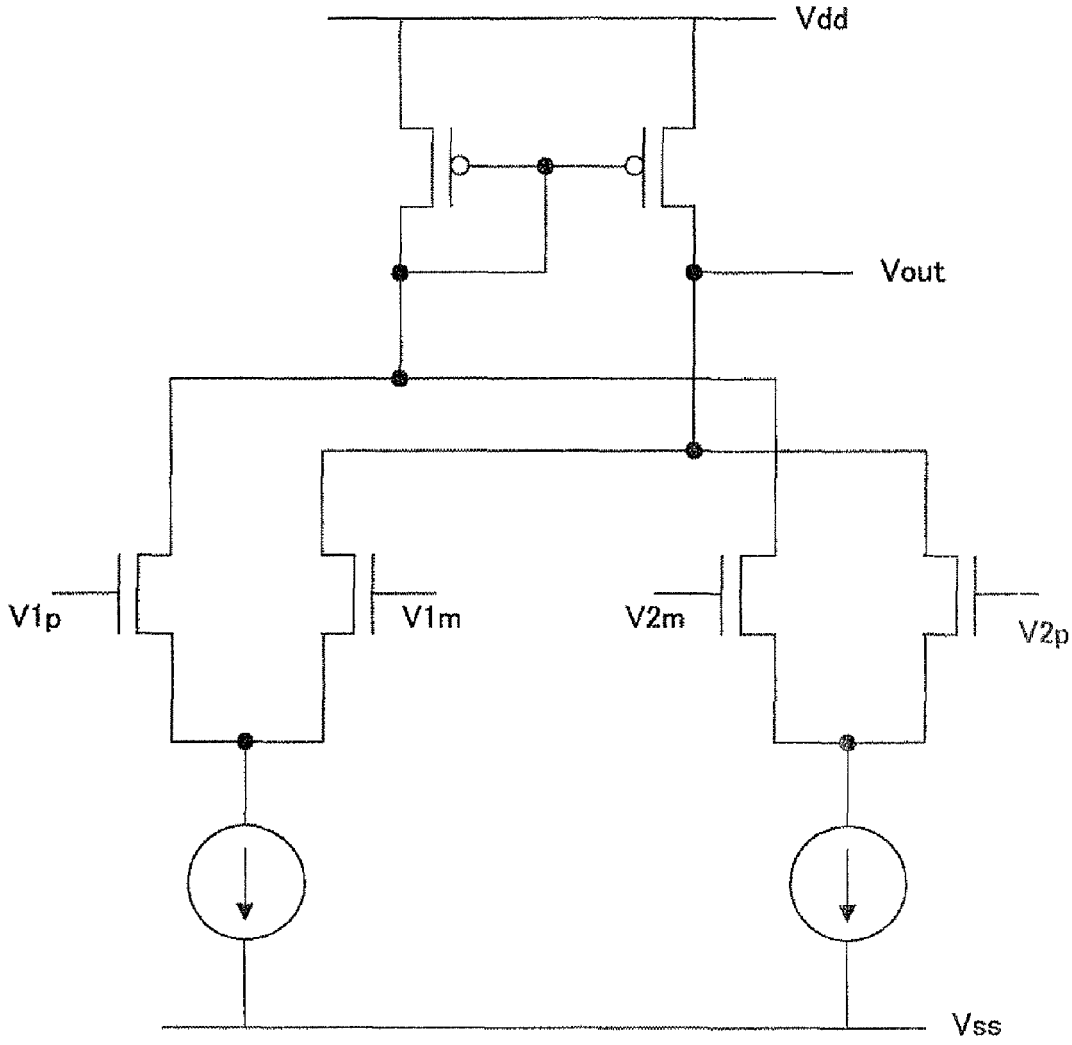
FIG. 10 is a circuit diagram in the case of configuring the differential amplifier shown in FIG. 9 by using a MOS transistor reversing a conductivity type.

The differential amplifier A1 configured as shown in FIG. 9 is suitable for the control circuit U1 of the bias circuit of FIG. 8. As the above described bias circuit 50 shown in FIG. 6 in which the transistors M1 and M2 are PMOS transistors can conceivably be configured to combine the input circuit of the NMOS transistor as shown in FIG. 10 with the load for the PMOS transistor. The configuration of the differential amplifier shown in FIG. 10 is also known and therefore a detailed description is not provided here.

There is a case in which the input voltage range and output voltage range are limited in a differential amplifier, and the configuration of FIG. 9 has the voltage input range at a relatively low level (i.e., close to Vss) and outputs by virtue of the load of a NMOS transistor, which therefore is suitable for driving the gate terminal of an NMOS transistor. Meanwhile, the differential amplifier configured as shown in FIG. 10 has the voltage input range at a relatively high level (i.e., close to Vdd) and outputs by virtue of the load of a PMOS transistor, which is therefore suitable for driving the gate terminal of a PMOS transistor.

Next is a description of an operation of the control circuit employing a differential amplifier A1 configured as shown in FIG. 9.

For simplicity of description, the assumption here is that the V1 is connected to "0" volts (Vss) and the V2 is provided with a voltage Vn. A further assumption is that the mirror ratio of the current mirror F1 is "1", and the gate width of the transistor M2 is a quarter of that of the transistor M1.

The bias circuit 60 shown in FIG. 7 is configured such that the gate terminal is connected to the drain terminal in the transistor M2, which is therefore configured as a diode connection. The current of the transistor M1 is replicated by the current mirror F1 and the same current amount as that of the transistor M1 flows in the transistor M2. Since the transistor M2 is in a diode connection, the gate terminal voltage of the transistor M2 becomes a value indicating the voltage between the gate and source so that the transistor M2 allows the same amount of current as that of the transistor M1 to flow.

The V2 and V1 (i.e., Vn and Vss) are respectively connected to the two positive differential input terminals of the differential amplifier A1. Meanwhile, the gate terminals of the transistors M1 and M2 are respectively connected to the two negative differential input terminals of the differential amplifier A1. Further, the output terminal of the differential amplifier A1 is connected to the gate terminal of the transistor M1, and the current of the transistor M1 is determined by the voltage between the gate and source.

First a description is given of the system of the bias circuit 60 forming a negative feedback loop.

The assumption here is that the gate terminal voltage of the transistor M1 (i.e., the output voltage Vout of the differential amplifier A1) is increased by a minute amount ΔV. In this case, the current that the transistor M1 allows to flow increases by a minute amount of current ΔI corresponding to the increase in the amount of ΔV. The ΔI is replicated by the current mirror F1 to the current of the transistor M2. This also increases the current of the transistor M2 by ΔI. In this event, the voltage between the gate and source of the transistor M2 increases by an amount corresponding to the amount of increase of ΔI (N.B.: the amount of the increase is equivalent to 2ΔV if the current of a transistor is expressed by the square-root law and if the gate width of the transistor M2 is a quarter of the gate width of the transistor M1). The gate terminal of the transistor M2 is connected to the positive input terminal of the negative differential input of the differential amplifier A1 and therefore the increase of the gate terminal voltage of the transistor M2 causes the output voltage Vout of the differential amplifier A1 to decrease by the amount of the voltage amplified by the gain of the differential amplifier A1.

As described above, if the gate terminal voltage of the transistor M1 increases by a minute amount, the output voltage Vout of the differential amplifier A1 decreases (by the amount 2G*ΔV, where the gain of the differential amplifier A1 is "G") and therefore the configuration of the bias circuit 60 results in negative feedback.

Assuming that the gain of the differential amplifier A1 is sufficiently large (e.g., a gain of about 40 dB=100 times), an input voltage after the convergence of the negative feedback loop can be regarded as the same, as in the case of a common differential amplifier.

That is, the negative differential input terminal is equal to the positive differential input voltage, and the difference in gate terminal voltages between the transistor M2 and transistor M1 is equal to the difference between the V2 and V1, that is, equal to Vn. The operation in this case is described by referring to the graph shown in FIG. 11.

Figure 11:
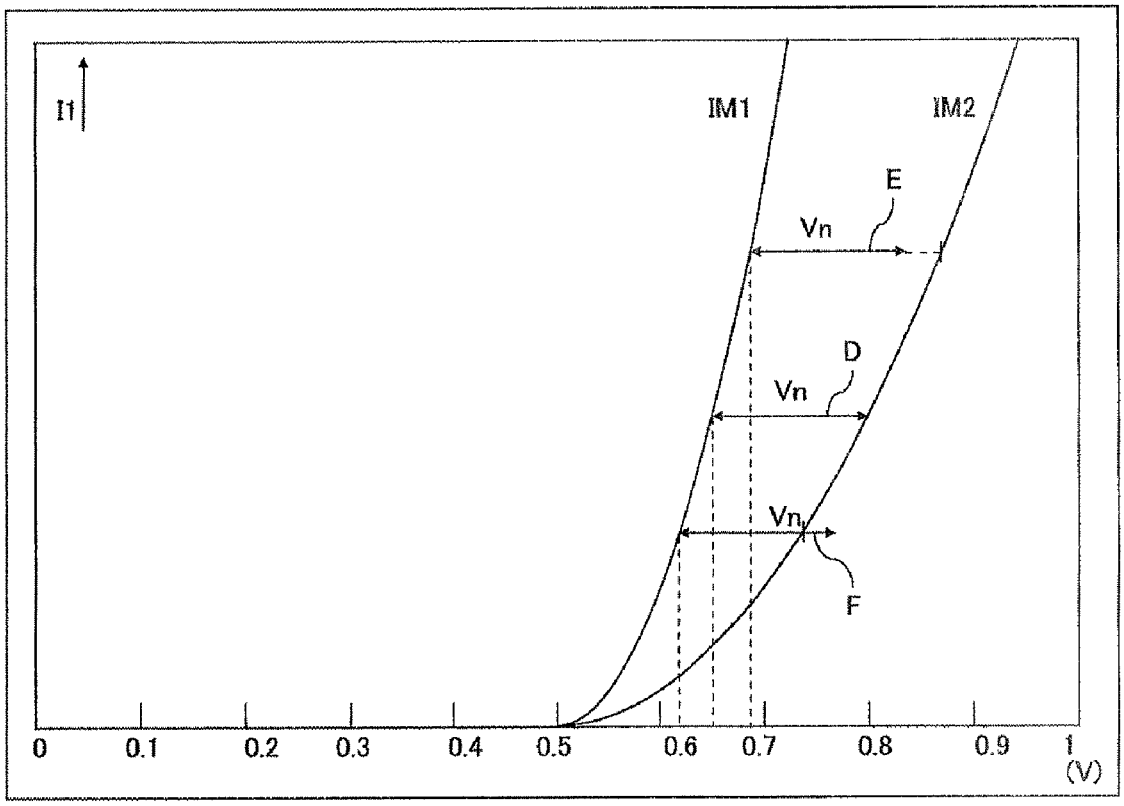
FIG. 11 is a graph for describing an operation of the bias circuit shown in FIG. 7.

In the graph shown in FIG. 11, the vertical axis is electric current, and the horizontal axis is the gate terminal voltage of a transistor, as in the graph of FIG. 4. The assumption here is that the threshold voltage of the NMOS transistor is 0.5 volts and the current follows the square-root law (i.e., $I=(\beta/2)(Vgs-Vth)^2$). In addition, Vn is assumed to be 0.15 volts.

The output voltage Vout of the differential amplifier A1 is the gate terminal voltage of the transistor M1 and, in the example shown in FIG. 11, the difference in gate terminal voltages between the transistors M1 and M2 is Vn when the differential amplifier A1 outputs 0.65 volts, and the "state of the currents flowing in the transistors M1 and M2 being the same" is achieved as indicated by the arrow D.

Next is a description of the operation of the bias circuit 60 shown in FIG. 7 converging by virtue of negative feedback.

As indicated by the arrow E in FIG. 11, if the output voltage Vout of the differential amplifier A1 is higher than 0.65 volts, the gate terminal voltage of the transistor M2 is higher than that of the transistor M1, and the difference is larger than the Vn, for the same current that causes the current mirror F1 to allow to flow. Therefore, since the negative differential input voltage of the differential amplifier A1 is larger than the positive differential input voltage, the output voltage Vout of the differential amplifier A1 decreases, thus making it eventually come close to a convergence voltage (of 0.65 volts).

In contrast, if the output voltage Vout of the differential amplifier A1 is lower than 0.65 volts, the gate terminal voltage of the transistor M2 is lower than that of the transistor M1, and the difference is smaller than the Vn, for the same current amount which the current mirror F1 lets it flow as indicated by the arrow F in FIG. 11. Therefore, since the negative differential input voltage of the differential amplifier A1 is smaller than the positive differential input voltage, the output voltage of the differential amplifier A1 increases, thus making it eventually come close to the convergence voltage (of 0.65 volts).

All of the bias circuits described above are configured to use the MOSFETs as transistors; the bias circuit according to the present invention, however, may also be configured to use a transistor other than the MOSFET. Further, the current mirror is also not limited to the configuration as described above.

APPLICABILITY TO INDUSTRY

The present invention is promising for use in the macro design of a system LSI operating on a low power-supply voltage.

What is claimed is:

1. A bias circuit, comprising:

a current mirror;

a first transistor in which a reference current of the current mirror flows;

a second transistor in which a replica current of the current mirror flows; and a control circuit configured to apply a voltage to gate terminals of the first and second transistors, wherein source terminals of the first and second transistors are coupled to a common fixed potential and the control circuit comprises two voltage input terminals, said control circuit controls a gate terminal voltage of said first transistor by utilizing a drain terminal of said second transistor, and said control circuit compares the replica current of said current mirror with a current of said second transistor, thereby controlling the gate terminal voltage of said first transistor.

2. A bias circuit, comprising:

a current mirror;

a first transistor in which a reference current of the current mirror flows;

a second transistor in which a replica current of the current mirror flows; and a control circuit configured to apply a voltage to gate terminals of the first and second transistors, wherein source terminals of the first and second transistors are coupled to a common fixed potential and the control circuit comprises two voltage input terminals, said control circuit to control a gate terminal voltage of said first transistor by utilizing a drain terminal of said second transistor, and wherein said control circuit to control the gate terminal voltage of said first transistor so that a difference in potentials between the gate terminal voltage of said first transistor and a gate terminal voltage of said second transistor is equal to a difference in potentials between a first voltage and a second voltage, and also so that the second transistor allows the same current amount as that of the replica current of said current mirror to flow.

3. A bias circuit, comprising:

a current mirror;

a first transistor in which a reference current of the current mirror flows;

a second transistor in which a replica current of the current mirror flows; and a control circuit configured to apply a voltage to gate terminals of the first and second transistors, wherein source terminals of the first and second transistors are coupled to a common fixed potential and the control circuit comprises two voltage input terminals, said control circuit to control a gate terminal voltage of said first transistor by utilizing a drain terminal of said second transistor, and said control circuit comprises a first voltage input terminal to which a first voltage is input and comprises a second voltage input terminal to which a second voltage is input, and said control circuit to control the gate terminal voltage of said first transistor so that a difference in potentials between the gate terminal voltage of said first transistor and a gate terminal voltage of said second transistor is equal to a difference in potentials between the first voltage and second voltage, and also so that the second transistor allows the same current amount as that of the replica current of said current mirror to flow.

4. The bias circuit according to claim 3, wherein said first voltage input terminal is connected to a reference power supply of said first transistor.

5. The bias circuit according to claim 3, wherein an overdrive voltage of said first transistor is equal to said second voltage.

6. The bias circuit according to claim 3, wherein said control circuit comprises a fifth transistor and a seventh transistor that are serially connected between a power supply and a fixed potential, and a sixth transistor and an eighth transistor that are serially connected between a power supply and a fixed potential, wherein a connection point between the fifth and seventh transistors is connected to the gate terminal of said second transistor, a connection point between the sixth and eighth transistors is connected to the gate terminal of said first transistor, and the fifth and sixth transistors generate a current based on a drain terminal voltage of the second transistor.

7. The bias circuit according to claim 6, wherein said first and second transistors are of a first conductivity type and said fifth, sixth, seventh and eighth transistors are of a second conductivity type.

8. The bias circuit according to claim 3, wherein said control circuit comprises a differential amplifier for comparing two differential signals and outputting a voltage, wherein the differential amplifier comprises input terminals to which said first and second voltages are input as first differential signals, and input terminals to which said drain terminal voltage and the output voltage of the differential amplifier are input as second differential signals, wherein an output terminal of the differential amplifier is connected to the gate terminal of said first transistor, and the gate terminal and drain terminal of said second transistor are interconnected.

* * * * *